US010586490B2

(12) United States Patent
Soda

(10) Patent No.: US 10,586,490 B2
(45) Date of Patent: Mar. 10, 2020

(54) DISPLAY DEVICE, ELECTRONIC DEVICE, AND METHOD OF DRIVING DISPLAY DEVICE WITH SELECTING OF SIGNAL LINES IN ORDER FROM ONE END TO ANOTHER AND VICE VERSA

(71) Applicant: CANON KABUSHIKI KAISHA, Tokyo (JP)

(72) Inventor: Takehiko Soda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/983,445

(22) Filed: May 18, 2018

(65) Prior Publication Data

US 2018/0342203 A1 Nov. 29, 2018

(30) Foreign Application Priority Data

May 25, 2017 (JP) ..... 2017-103791

(51) Int. Cl.
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/0814* (2013.01); *G09G 2300/0819* (2013.01); *G09G 2300/0852* (2013.01); *G09G 2310/0205* (2013.01); *G09G 2310/0218* (2013.01); *G09G 2310/0283* (2013.01); *G09G 2320/029* (2013.01); *G09G 2320/0233* (2013.01)

(58) Field of Classification Search
CPC ... G09G 2300/0814; G09G 2300/0819; G09G 2300/0852
See application file for complete search history.

(56) References Cited

U.S. PATENT DOCUMENTS

2008/0309599 A1* 12/2008 Tsuda ..... G09G 3/3688 345/88
2010/0024733 A1 2/2010 Soda et al.
2015/0179120 A1* 6/2015 Nakagawa ..... G09G 3/3674 345/204

FOREIGN PATENT DOCUMENTS

JP 2012-255873 A 12/2012
JP 2012255873 * 12/2012 ..... G09G 3/20

* cited by examiner

*Primary Examiner* — Chun-Nan Lin
(74) *Attorney, Agent, or Firm* — Venable LLP

(57) ABSTRACT

A display device in which selection circuits and display blocks are arranged is provided. Each of display blocks comprises signal lines extending in a column direction and pixels arranged in a matrix pattern. Pixels each comprise a light emitting element. Each of selection circuits switches a signal line to which to supply an image signal among signal lines such that the image signal is written to each pixel aligned in a row direction among pixels. In one frame period, an order in which signal lines corresponding to respective pixels arranged in a first row among the pixels aligned in the row direction are selected, and an order in which signal lines corresponding to respective pixels arranged in a second row different to the first row among the pixels aligned in the row direction are selected are different to each other.

6 Claims, 9 Drawing Sheets

DISPLAY DEVICE, ELECTRONIC DEVICE, AND METHOD OF DRIVING DISPLAY DEVICE WITH SELECTING OF SIGNAL LINES IN ORDER FROM ONE END TO ANOTHER AND VICE VERSA

BACKGROUND OF THE INVENTION

Field of the Invention

The present invention relates to a display device, an electronic device, and a method of driving a display device.

Description of the Related Art

Interest is given to display devices provided with a light emitting element that uses organic electroluminescence (EL) induced by an organic material that emits light as a light emitting layer. In a display device that uses organic EL, when supplying a signal for an image to each pixel, a configuration for providing a 1-input N-output type selection circuit, dividing a plurality of signal lines into a block for each selection circuit, and supplying the signal to the pixel while switching an output destination in each block is known. When using such a selection circuit, it is possible to decrease output circuits and a number of outputs from a driving circuit in comparison to a case of supplying a signal from a driving circuit to all signal lines. However, in each horizontal scan period, because the signal is supplied in the same order to signal lines connected to the selection circuit, due to a leakage current or the like in a pixel, a difference in electric potential for a signal can occur in accordance with an amount of time of holding of a signal for each signal line column even in the case of supplying the same signal. In a case where a difference in electric potential of a signal occurs for each column, display unevenness will occur for each column on a screen that is displayed, and image quality of a displayed image can decrease.

Japanese Patent Laid-Open No. 2012-255873 describes configuring so that a signal line designated as a first output destination and a signal line designated as a final output destination are not adjacent. By such a method of driving, it is possible to reduce a luminance difference between columns that are adjacent to each other more than in a case where a signal line designated as a first output destination and a signal line designated as a final output destination are selected to be adjacent.

SUMMARY OF THE INVENTION

With the method of driving described in Japanese Patent Laid-Open No. 2012-255873, the luminance difference between columns that are adjacent to each other becomes smaller. However, because an electric potential difference for a signal of each signal line column connected to a selection circuit does not change between a signal line designated as a first output destination and a signal line designated as a final output destination, there is the possibility of display unevenness occurring for each column, and image quality decreasing.

An embodiment of a portion of the present invention provides a technique for reducing luminance difference for each column in a display device.

According to some embodiments, a display device in which a plurality of selection circuits and a plurality of display blocks are arranged such that one selection circuit corresponds to one display block, wherein each of the plurality of display blocks comprises a plurality of signal lines extending in a column direction, and a plurality of pixels each connected to one of the plurality of signal lines and arranged in a matrix pattern in the column direction and a row direction that intersects the column direction, the plurality of pixels each comprise a light emitting element, each of the plurality of selection circuits switches a signal line to which to supply an image signal among the plurality of signal lines such that the image signal is written to each pixel aligned in the row direction among the plurality of pixels, and in one frame period, an order in which the plurality of signal lines corresponding to respective pixels arranged in a first row among the pixels aligned in the row direction are selected, and an order in which the plurality of signal lines corresponding to respective pixels arranged in a second row different to the first row among the pixels aligned in the row direction are selected are different to each other, is provided.

According to some other embodiments, a display device in which a plurality of selection circuits and a plurality of display blocks are arranged such that one selection circuit corresponds to one display block, wherein each of the plurality of display blocks comprises a plurality of signal lines extending in a column direction, and a plurality of pixels respectively connected to one of the plurality of signal lines and arranged in a matrix pattern in the column direction and a row direction that intersects the column direction, the plurality of pixels each comprise a light emitting element, each of the plurality of selection circuits switches a signal line to which to supply an image signal among the plurality of signal lines such that the image signal is written to each pixel aligned in the row direction among the plurality of pixels, and for each pixel arranged in a first row among pixels aligned in the row direction, an order in which a signal line to which to supply an image signal among the plurality of signal lines corresponding to respective pixels arranged in the first row is selected differs in a first frame period and a second frame period different from the first frame period, is provided.

According to some other embodiments, an electronic device comprising a display device in which a plurality of selection circuits and a plurality of display blocks are arranged such that one selection circuit corresponds to one display block, wherein each of the plurality of display blocks comprises a plurality of signal lines extending in a column direction, and a plurality of pixels each connected to one of the plurality of signal lines and arranged in a matrix pattern in the column direction and a row direction that intersects the column direction, the plurality of pixels each comprise a light emitting element, each of the plurality of selection circuits switches a signal line to which to supply an image signal among the plurality of signal lines such that the image signal is written to each pixel aligned in the row direction among the plurality of pixels, and in one frame period, an order in which the plurality of signal lines corresponding to respective pixels arranged in a first row among the pixels aligned in the row direction are selected, and an order in which the plurality of signal lines corresponding to respective pixels arranged in a second row different to the first row among the pixels aligned in the row direction are selected are different to each other, is provided.

According to some other embodiments, a method of driving a display device in which a plurality of selection circuits and a plurality of display blocks are arranged such that one selection circuit corresponds to one display block, each of the plurality of display blocks comprising a plurality of signal lines extending in a column direction, and a plurality of pixels each connected to one of the plurality of signal lines and arranged in a matrix pattern in the column direction and a row direction that intersects the column direction, the plurality of pixels each comprising a light emitting element, each of the plurality of selection circuits switching a signal line to which to supply an image signal among the plurality of signal lines such that the image signal is written to each pixel aligned in the row direction among the plurality of pixels, the method comprising: driving so that, in one frame period, an order in which the plurality of signal lines corresponding to respective pixels arranged in a first row among the pixels aligned in the row direction are selected, and an order in which the plurality of signal lines corresponding to respective pixels arranged in a second row different to the first row among the pixels aligned in the row direction are selected are mutually different, is provided.

According to some other embodiments, a method of driving a display device in which a plurality of selection circuits and a plurality of display blocks are arranged such that one selection circuit corresponds to one display block, each of the plurality of display blocks comprising a plurality of signal lines extending in a column direction, and a plurality of pixels respectively connected to one of the plurality of signal lines and arranged in a matrix pattern in the column direction and a row direction that intersects the column direction, the plurality of pixels each comprising a light emitting element, each of the plurality of selection circuits switching a signal line to which to supply an image signal among the plurality of signal lines such that the image signal is written to each pixel aligned in the row direction among the plurality of pixels, the method comprising driving so that, for each pixel arranged in a first row among pixels aligned in the row direction, an order in which each of the plurality of selection circuits selects a signal line to which to supply an image signal among the plurality of signal lines corresponding to respective pixels arranged in the first row differs in a first frame period and a second frame period different from the first frame period, is provided.

Further features of the present invention will become apparent from the following description of exemplary embodiments (with reference to the attached drawings).

DESCRIPTION OF THE EMBODIMENTS

Figure 1:
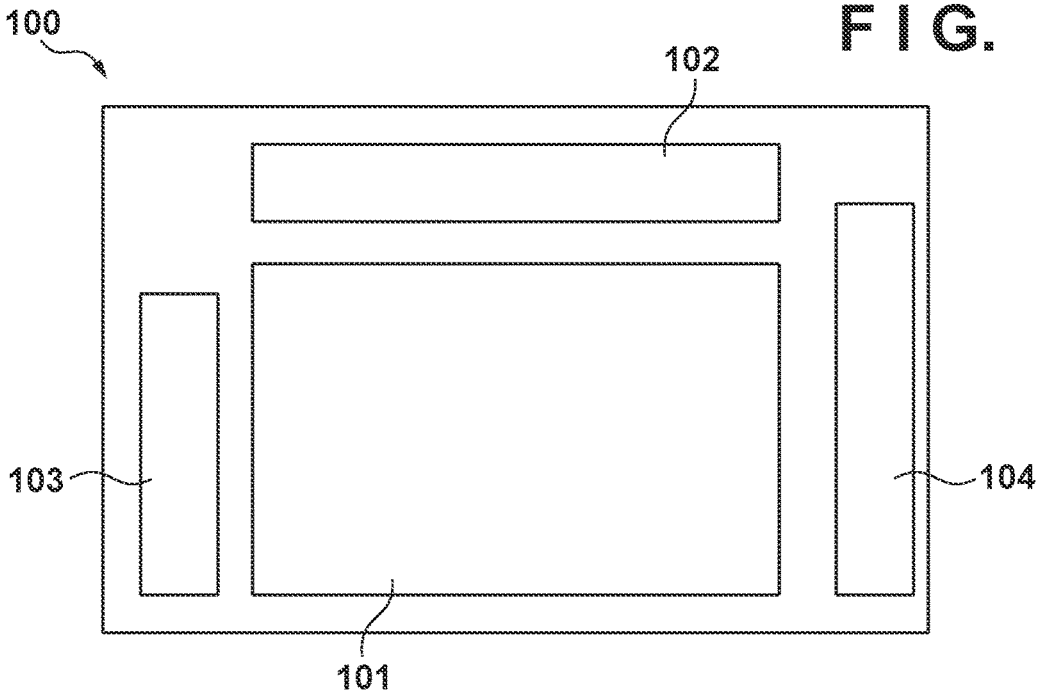
FIG. 1 is an overall conceptual diagram of a display device according to an embodiment of the present invention.

With reference to the attached drawings, description is given below for a detailed embodiment of a display device according to the present invention. Note that, in the following description and the drawings, the same reference numerals are given to configurations that are the same across a plurality of drawings. Accordingly, common configurations are described with mutual reference to the plurality of drawings, and description of configurations to which common reference numerals are given is abbreviated as appropriate.

With reference to FIGS. 1 through 6, description is given regarding a configuration of a display device according to embodiments of the present invention, and a method of driving the same. FIG. 1 is an overall conceptual diagram indicating an example of a display device 100 in a first embodiment of the present invention. The display device 100 is used as an organic light-emitting display provided with an organic light emitting element that uses organic electroluminescence (EL) induced by an organic material that emits light as a light emitting layer.

The display device 100 includes a display region 101, a horizontal driving circuit 102, a vertical driving circuit 103, and a connecting terminal unit 104. In the display region 101, a plurality of pixels, taking red (R), green (G), and blue (B) as one pixel, that are for displaying an image or the like is arranged in a matrix pattern. In each pixel is arranged organic light emitting elements for emitting light of each color for red (R), green (G), and blue (B), and a driving circuit for driving an organic light emitting element is arranged for each single organic light emitting element. In the present embodiment, description of an example in which organic light emitting elements for the three colors of red (R), green (G), and blue (B) are arranged in one pixel, but there is no limitation to this. For example, in the case of a display device that displays only a single color, an organic light emitting element of one color may configure one pixel. The horizontal driving circuit 102 is a circuit for outputting an image data signal such as luminance information to each pixel. The vertical driving circuit 103 is a circuit for outputting a signal for controlling the driving circuit of each pixel. The connecting terminal unit 104 is a terminal for inputting a clock signal, an image data signal, or the like to the horizontal driving circuit 102 and the vertical driving circuit 103, and is connected to the horizontal driving circuit 102 and the vertical driving circuit 103 by wiring (not shown).

Next, description is given regarding the pixels used in an organic light-emitting apparatus of the present embodiment. As described above, in one pixel there are arranged organic light emitting elements for the three colors of red (R), green (G), and blue (B), but for the description, a driving circuit for an organic light emitting element 111 of one color out of these three colors is illustrated for a pixel 110 of FIG. 2. In the configuration illustrated in FIG. 2, the pixel 110 includes a current driven type organic light emitting element 111 whose emission luminance changes in accordance with a current flowing to the light emitting element, and a driving circuit for driving the organic light emitting element 111. For the organic light emitting element 111, a cathode electrode is connected to a common power supply 125 which is arranged in common to the organic light emitting elements for all pixels arranged in the display region 101.

The driving circuit for driving the organic light emitting element 111 includes a drive transistor 112, a selection transistor 113, switching transistors 114 and 115, and capacitive elements 116 and 117. In the present embodiment, a p-channel type transistor (PMOS transistor) is used for each of the drive transistor 112, the selection transistor 113, and the switching transistors 114 and 115.

The drive transistor 112 supplies a driving current to the organic light emitting element 111 in accordance with being connected in series to the organic light emitting element 111. Specifically, the drain electrode of the drive transistor 112 is connected to an anode electrode of the organic light emitting element 111.

For the selection transistor 113, its gate electrode is connected to a scanning line 121, its source electrode is connected to a signal line 124, and its drain electrode is connected to the gate electrode of the drive transistor 112. A signal from the vertical driving circuit 103 is applied to the gate electrode of the selection transistor 113 via the scanning line 121.

For the switching transistor 114, its gate electrode is connected to a scanning line 122, its source electrode is connected to a power supply electric potential VDD, and its drain electrode is connected to the source electrode of the drive transistor 112. A signal for controlling light emission by the organic light emitting element 111 from the vertical driving circuit 103 is applied to the gate electrode of the switching transistor 114 via the scanning line 122. For the switching transistor 115, its gate electrode is connected to a scanning line 123, its source electrode is connected to a power supply electric potential VSS, and its drain electrode is connected to the anode electrode of the organic light emitting element 111. A signal for controlling the electric potential of the anode electrode of the organic light emitting element 111 from the vertical driving circuit 103 is applied to the gate electrode of the switching transistor 115 via the scanning line 123.

A capacitive element 116 is connected between the gate electrode and the source electrode of the drive transistor 112. A capacitive element 117 is connected between the first power supply electric potential VDD and the source electrode of the drive transistor 112.

The vertical driving circuit 103 to which the scanning lines 121, 122, and 123 are connected sequentially supplies signals to pixels, in units of rows, arranged in the display region 101. As a result, a signal voltage such as image data and a reference voltage are respectively held by the capacitive elements 116 and 117 of the pixel 110, and are controlled so that the organic light emitting element 111 emits light at a luminance in accordance with the signal voltage.

Figure 2:
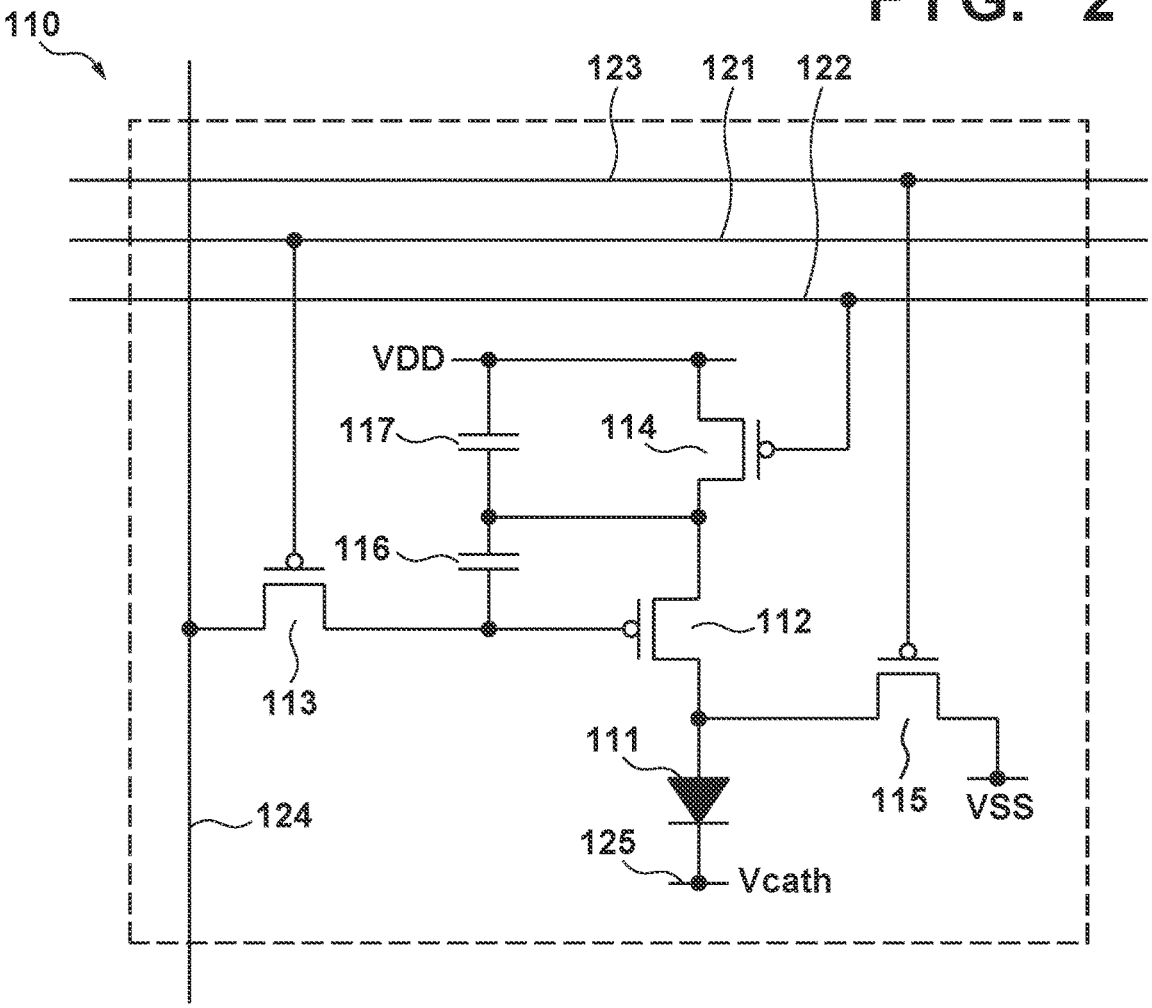
FIG. 2 is an equivalent circuit diagram of a pixel of the display device in FIG. 1.

In the configuration illustrated in FIG. 2, PMOS transistors are used for each of the transistors, but there is no limitation to this, and configuration may be taken to use n-channel type transistors (NMOS transistors). In addition, the driving circuit is not limited to a 4Tr 2C circuit configuration that includes four transistors and two capacitive elements. In addition, for a transistor, one formed on a silicon wafer may be used, and a thin-film transistor formed on a semiconductor film deposited on a glass substrate may be used.

In the pixel 110, the selection transistor 113 enters a conductive state in response to a write signal from the vertical driving circuit 103 applied to the gate electrode through the scanning line 121. In accordance with this action, an image signal (a signal voltage) in accordance with the luminance information or a reference voltage is sampled from the signal line 124. By sampling the reference voltage from the signal line 124, it is possible to correct threshold voltage variation of the drive transistor 112 of each pixel, and reduce luminance variation of each pixel in accordance with the threshold voltage variation. The image signal or the reference voltage is applied to the gate electrode of the drive transistor 112 and is also held in the capacitive element 116.

The drive transistor 112 can be designed so as to operate in a saturated region. The drive transistor 112 receives a supply of current from the power supply electric potential VDD via the switching transistor 114 to cause the organic light emitting element 111 to emit light by current driving. At this time, because a current amount flowing to the organic light emitting element 111 is decided in accordance with the voltage held by the capacitive element 116, it is possible to control the amount of light emitted by the organic light emitting element 111. The switching transistor 114 enters a conductive state in accordance with a signal from the vertical driving circuit 103 for controlling light emission being applied to the gate electrode through the scanning line 122. In other words, the switching transistor 114 has a function for controlling emission and non-emission by the organic light emitting element 111.

The switching transistor 115 selectively supplies the anode electrode of the organic light emitting element 111 with a power supply electric potential VSS in accordance with a signal from the vertical driving circuit 103 for controlling the electric potential of the anode electrode of the organic light emitting element 111 being applied to the gate electrode of the switching transistor 115 via the scanning line 123. Letting the voltage of the common power supply 125 connected to the cathode electrode of the organic light emitting element 111 be Vcath and the threshold voltage of the organic light emitting element 111 be Vthel, the power supply electric potential VSS is designed so as to satisfy the condition of $VSS<Vcath+Vthel$. As a result, when the switching transistor 115 is in the conductive state, it is possible to apply a reverse bias to the organic light emitting element 111 to thereby perform control to make the organic light emitting element 111 enter a non light emission state.

Figure 3A:
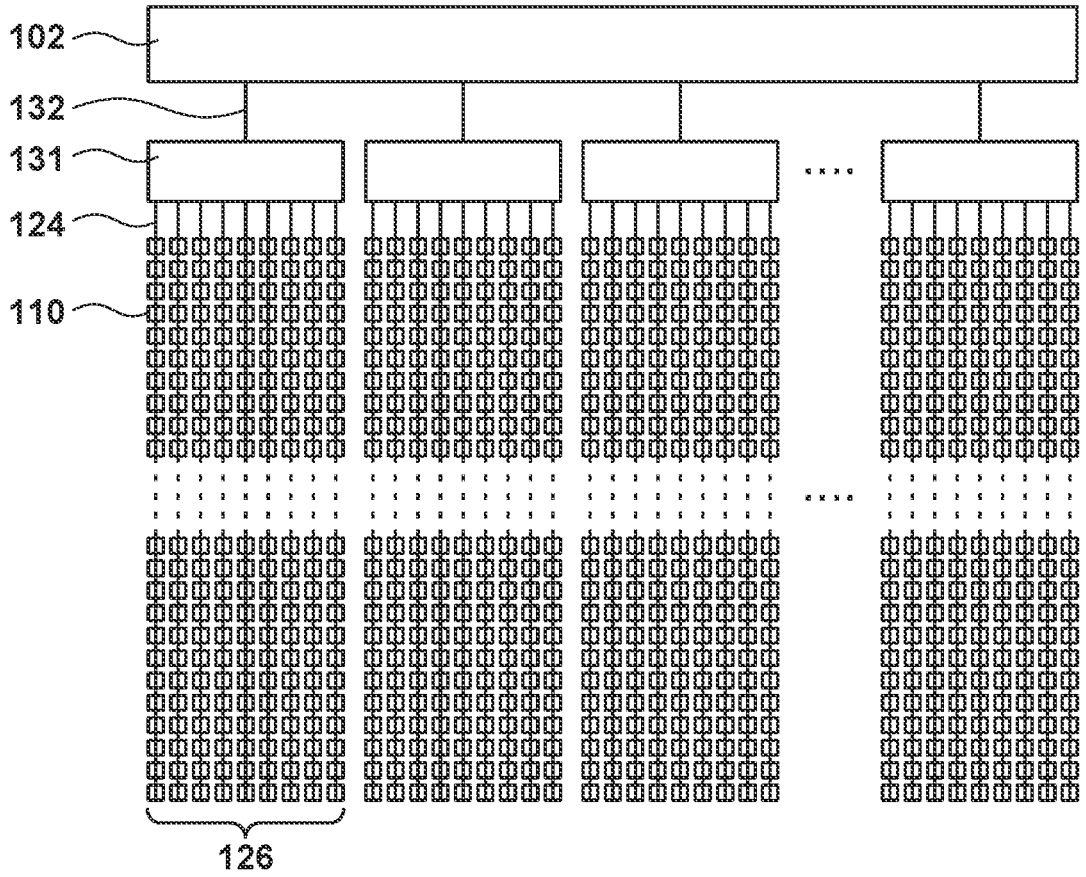
FIGS. 3A and 3B are conceptual diagrams of an interface of the display device in FIG. 1.
Figure 3B:
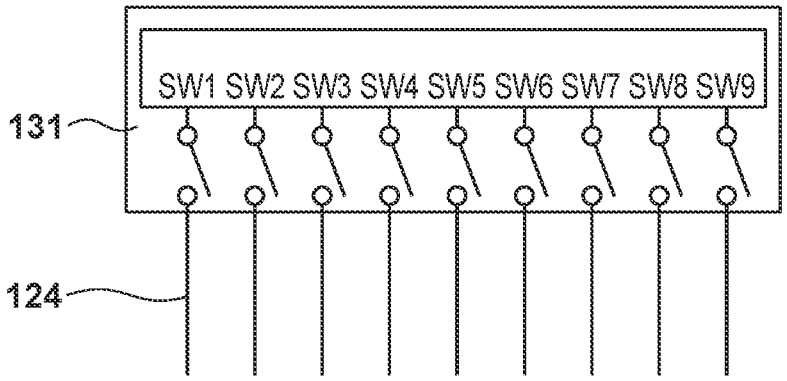

Next, using FIGS. 3A and 3B, description is given for a configuration of an interface for transferring an image signal which is luminance information to the signal lines 124 for supply to respective pixels 110. In the present embodiment, as illustrated in FIG. 3A, the signal lines 124 and the pixels 110 are divided into a plurality of display blocks 126 and controlled. Each of the plurality of display blocks 126 includes a plurality of signal lines 124 that extends in a column direction and a plurality of pixels 110 that are arranged in a matrix pattern in the column direction and a row direction that intersects the column direction, each pixel being connected to one of the plurality of signal lines 124. Each pixel is inputted with an image signal via a signal line 124. In FIG. 3A, a direction in which the signal lines 124 extend is referred to as the column direction, and a direction that intersects with the column direction is referred to as the row direction. In addition, between the horizontal driving circuit 102 of the display device 100 and the display blocks 126, a plurality of selection circuits 131 for selecting a signal line 124 for supplying an image signal is arranged. The plurality of selection circuits 131 and the plurality of display blocks 126 are arranged so that one selection circuit 131 corresponds to one display block 126. A selection circuit 131 is a publicly known circuit where a circuit capable of selectively outputting an image signal supplied from a video signal line 132 to a signal line 124 connected to an output terminal is used, and a switch circuit is provided for each output terminal. In the case where the number of signal lines 124 outputted from one selection circuit 131 is M [lines] and the number of selection circuits 131 is N, the total number of signal lines 124 is M×N [lines]. In the configuration illustrated in FIG. 3A, illustration is given of an example where the number of signal lines 124 included in each display block 126 out of the plurality of display blocks 126 is the same at 9 lines for each. Accordingly, in order to make it possible to output to one selection circuit 131 an image signal to be switched among nine signal lines 124, nine switch circuit SWs for selecting a signal line 124 to supply the image signal to are provided in the one selection circuit 131, as illustrated in FIG. 3B. In addition, in the case of the configuration illustrated in FIGS. 3A and 3B, an image signal write operation is performed nine times using the switch circuits SW in one horizontal scan period for supplying image signals to each pixel 110 that is aligned in the row direction out of the plurality pixels 110 arranged in one display block 126.

Figure 4:
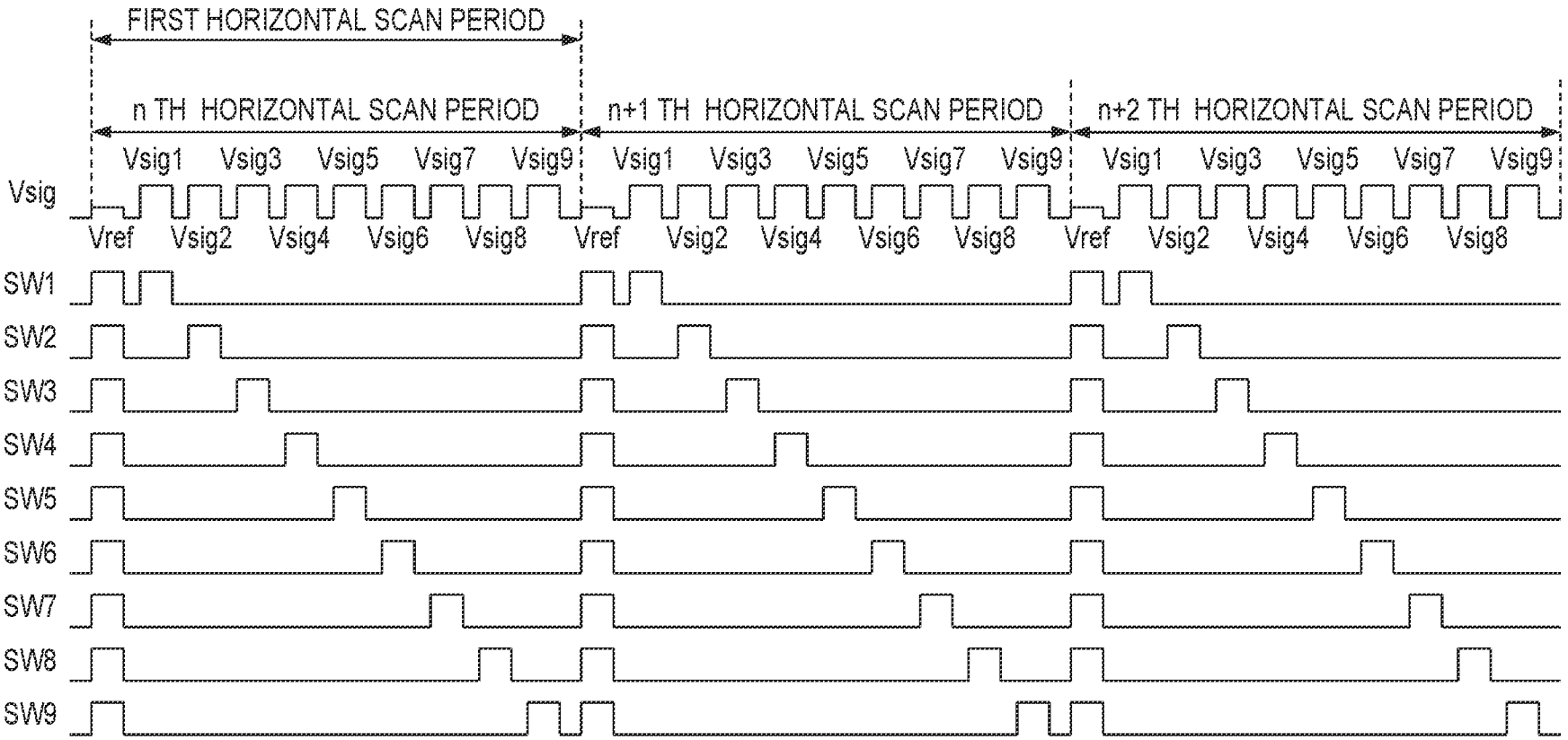
FIG. 4 is a diagram that illustrates an example of a driving method of a selection circuit of a display device of a comparative example.
Figure 5:
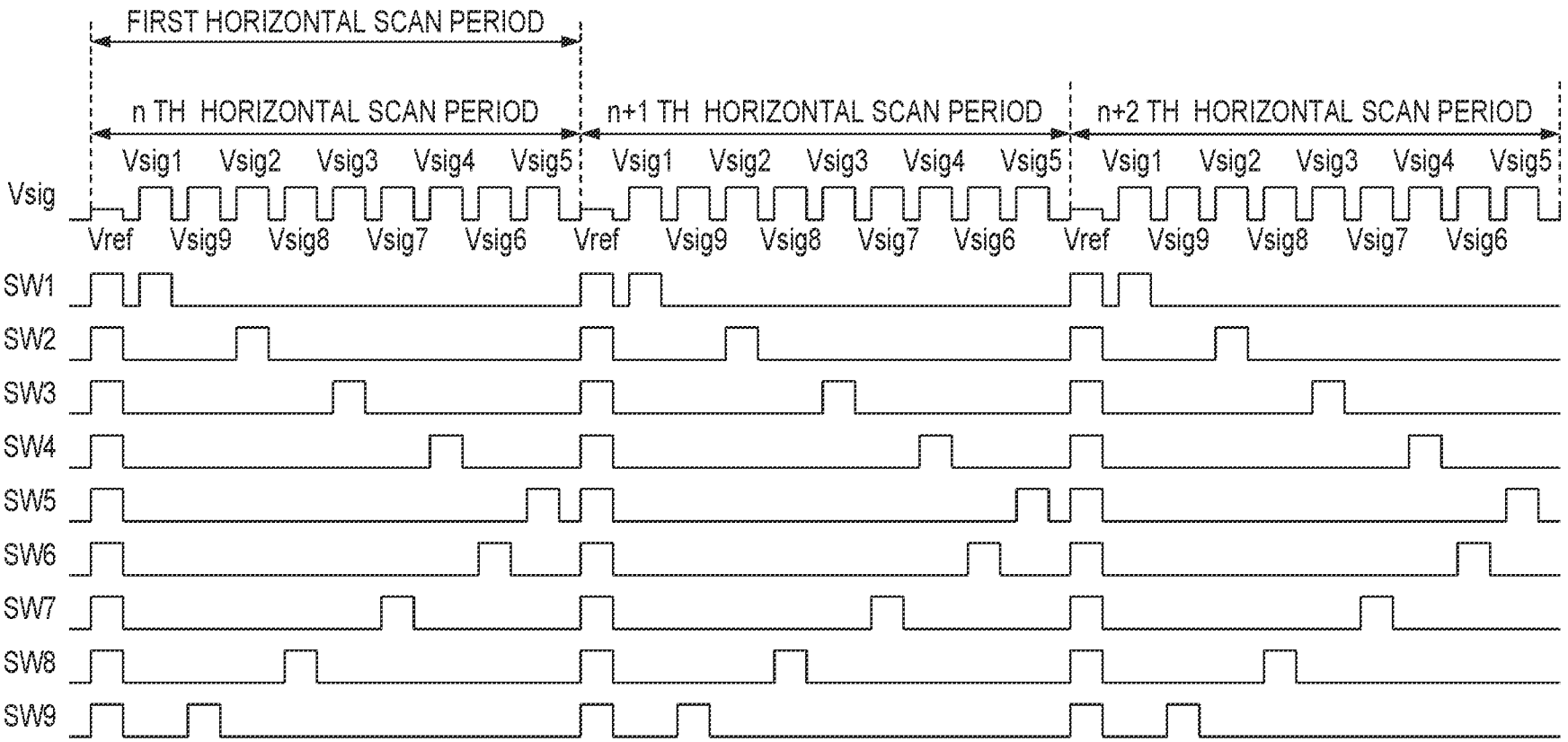
FIG. 5 is a diagram that illustrates an example of a driving method of a selection circuit of a display device of a comparative example.

Here, the problem to be solved in the present embodiment is described using FIGS. 4 and 5. FIG. 4 is a timing chart illustrating a comparative example of a driving method that uses a selection circuit 131. In one horizontal scan period, image signals are supplied to nine pixels 110 arranged in one row of a display block 126 out of the plurality of pixels 110. Here, one horizontal scan period refers to a period from a timing for writing an initialization voltage Vref to the signal line 124 for a row (row n) until when the initialization voltage Vref is written to the next row (row n+1). FIG. 4 illustrates a writing operation for image signals for three rows in three horizontal scan periods. The "Vsig" in FIG. 4 indicates voltages of image signals supplied to the video signal line 132, and "SW1" through "SW9" indicate the operation status of the switch circuits SW for selecting each of the nine signal lines 124.

Firstly, threshold correction for the drive transistors 112 for the pixels 110 included in one row is performed. In a state where the initialization voltage Vref is supplied to the video signal line 132 (Vsig), the selection circuit 131 has the switch circuits SW1 through SW9 enter the on (conductive) state at the same timing. As a result, the initialization voltage Vref is supplied to the signal lines 124 all at once. Subsequently, the image signals Vsig1 through Vsig9 are successively supplied to the video signal line 132, and the selection circuit 131 successively has the switch circuits SW1 through SW9 that are connected to corresponding signal lines 124 enter the on state. As a result, the image signals Vsig1 through Vsig9 which are image signals are successively supplied to the corresponding signal lines 124. In the example illustrated in FIG. 4, image signals are supplied in the order of the image signals Vsig1, Vsig2, . . . , Vsig9 to the nine signal lines 124 connected to one selection circuit 131. The selection circuit 131 performs these operations in one horizontal scan period. The image signal supplied to each signal line 124 is applied to the scanning line 121 for each corresponding row, and, by the selection transistors 113 entering the on state all at once, is written to the capacitive element 116 of each pixel 110. The signal line 124 has wiring capacitance, and thus can hold the image signal supplied to the signal line 124 in the interval until the selection transistor 113 enters the on state. The selection circuit 131 is driven so as to repeatedly perform similar circuit operations in an (n+1)-th horizontal scan period and (n+2)-th horizontal scan period after an n-th horizontal scan period. In addition, the selection circuit 131 is driven so as to repeatedly perform similar circuit operations across all frame periods. In other words, the order for supplying image signals in one horizontal scan period is the same order in all horizontal scan periods.

Because image signals are supplied in order to the nine signal lines 124 of the display block 126 connected to the one selection circuit 131, an amount of time over which the voltage of the image signals is held in the signal lines 124 in one horizontal scan period differs for each signal line 124. Due to influences such as a leakage current from a transistor such as the selection transistor 113 or coupling with other wiring (the scanning lines 121, 122, and 123 and the signal lines 124), the voltage of an image signal held in a signal line 124 can vary in accordance with a difference in an amount of time for holding by the signal line 124. In the case where the voltage of an image signal varies in accordance with an amount of time that the image signal is held in a signal line 124, there is the possible of an electric potential difference occurring between the nine signal lines 124, even in the case where an image signal of the same voltage is written to the signal lines 124 include in the display block 126. Because a luminance difference in light emission by the organic light emitting element 111 occurs in accordance with an electric potential difference between signal lines 124, there is a possibility of display unevenness occurring in a vertical stripe shape (column direction) due to the luminance difference. In addition, because the organic light emitting element 111 is self-lighting and thus it is easy for the luminance to steadily decrease in a case of light emission for a long time, a luminance difference in accordance with the electric potential difference between signal lines 124 can change over time. In this way, in the case of using the method of driving illustrated in FIG. 4, a luminance difference can occur for each column in a display device.

FIG. 5 is a timing chart illustrating a comparative example of a driving method that uses a selection circuit 131. The order at which the image signals Vsig1 through Vsig9 are supplied to the video signal line 132 and the order for having the corresponding switch circuits SW1 through SW9 of the selection circuit 131 enter the on state to switch signal lines 124 for supplying image signals is different from the comparative example illustrated in FIG. 4. Other than this may be the same as in FIG. 4. In the example illustrated in FIG. 5, the image signals are written by first making the switch circuit SW1 enter the on state, and then making the switch circuits SW enter the on state in an order of the switch circuits SW9, SW2, SW8, SW3, . . . from outward sides of the display block 126 to the inside thereof, and finally the switch circuit SW5 is made to enter the on state. In other words, an image signal is first supplied to a signal line 124 for one end of the display block 126 that corresponds to the switch circuit SW1, and a signal is supplied last to a center signal line 124 corresponding to the switch circuit SW5. In the display block 126, because the signal line 124 to which an image signal is first supplied in one horizontal scan period and the signal line 124 to which an image signal is last supplied are not adjacent, luminance difference occurring between adjacent signal lines 124 is reduced, and it is possible to alleviate vertical stripe shaped display unevenness. However, vertical stripe shape display unevenness remains because the amount of time that a signal is held differs for each column (signal line 124).

Figure 6:
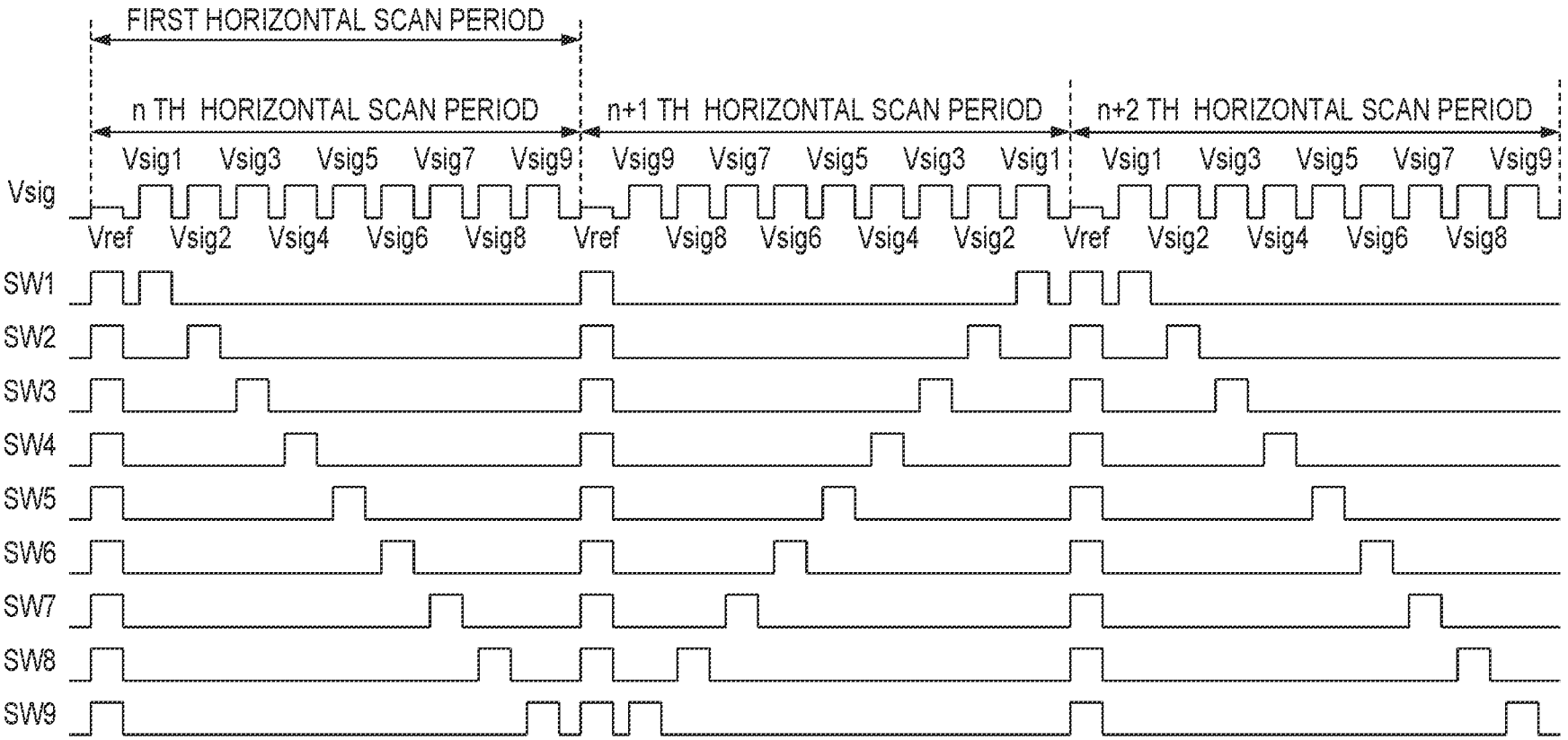
FIG. 6 is a diagram that illustrates an example of a driving method of a selection circuit of the display device of FIG. 1.

Next, FIG. 6 is used to give a description for a method of driving the selection circuit 131 in the present embodiment. With the method of driving that is illustrated by the timing chart of FIG. 6, the selection circuit 131 switches a signal line 124 for supplying an image signal out of the plurality of signal lines 124 so that an image signal is written to each pixel 110 lined up in a row direction out of the plurality of pixels 110. However, for the selection circuit 131, in one frame period, an order in which a plurality of signal lines 124 corresponding to respective pixels arranged in a first row out of pixels 110 that are aligned in the row direction are selected and an order in which a plurality of signal lines 124 corresponding to respective pixels arranged in a second row different from the first row out of the pixels 110 that are aligned in the row direction are selected are different from each other. In other words, unlike comparative examples illustrated in FIG. 4 and FIG. 5, an order in which the switch circuits SW are made to enter the on state and image signals are supplied to the signal line 124 differs in accordance with the horizontal scan periods in one frame period. In other words, in a case where a horizontal scan period in one frame period is extracted, there is a horizontal scan period in which an order for supplying image signals to the signal lines 124 is different.

Firstly, threshold correction for the drive transistor 112 for each pixel 110 included in one row is performed. In a state where the initialization voltage Vref is supplied to the video signal line 132 (Vsig), the selection circuit 131 has the switch circuits SW1 through SW9 enter the on (conductive) state at the same timing. As a result, the initialization voltage Vref is supplied to the signal lines 124 all at once. Subsequently, the image signals Vsig1 through Vsig9 are successively supplied to the video signal line 132, and the selection circuit 131 successively selects the switch circuits SW1 through SW9 that are connected to corresponding signal lines 124 to have them enter the on state. As a result, the image signals Vsig1 through Vsig9 are successively supplied to the corresponding signal lines 124.

In the present embodiment, in the n-th horizontal scan period, the selection circuit 131 makes the switches enter the on state in an order of the switch circuits SW1, SW2, SW3, . . . , SW9 with respect to the nine signal lines 124. In response to this, image signals are supplied to the corresponding signal lines 124 in an order of the image signals Vsig1, Vsig2, Vsig3, . . . Vsig9. Subsequently, a signal is applied to the scanning line 121 of the corresponding row, the selection transistors 113 connected to the scanning line 121 enter the on state all at once, and the image signals Vsig1 through Vsig9 are written to the capacitive elements 116 of the respectively corresponding pixels 110.

Next, in the (n+1)-th horizontal scan period which is the next row scanned after the row scanned in the n-th horizontal scan period, the selection circuit 131 makes the switches enter the on state in the order of the switch circuits SW9, SW8, SW7, . . . , SW1 with respect to the nine signal lines 124. In response to this, image signals are supplied to the signal lines 124 in an order of the image signals Vsig9, Vsig8, Vsig7, . . . , Vsig1. Subsequently, a signal is applied to the scanning line 121 of the corresponding row, the selection transistors 113 connected to the scanning line 121 enter the on state all at once, and the image signals Vsig1 through Vsig9 are written to the capacitive elements 116 of the respectively corresponding pixels 110.

Furthermore, in the (n+2)-th horizontal scan period, the selection circuit 131 makes the switch circuits SW1 through SW9 enter the on state and supplies signal voltages to the signal lines 124 in the same order as for the n-th horizontal scan period. In the (n+3)-th horizontal scan period and thereafter, image signals are respectively supplied to the signal lines 124 in similar orders for (n+1)-th horizontal scan period and the (n+2)-th horizontal scan period.

In this way, by having the order for supplying image signals to the signal lines 124 be an order that differs in accordance with the horizontal scan period, it is possible to make the amount of time that the image signals are held by the signal lines 124 be more equal when averaged over a plurality of horizontal scan periods. Accordingly, the luminance difference for the organic light emitting element 111 that occurs for each column is averaged when seen by a plurality of rows, and thus it is possible to suppress display unevenness for the display region 101 overall.

With the configuration illustrated in FIG. 6, illustration was given of an example in which, in one frame period, for each row where a plurality of the pixels 110 which are arranged in a matrix pattern are mutually adjacent, the selection circuit 131 changes an order for selecting signal lines 124 to supply with image signals out of the plurality of signal lines 124. However, there is no limitation to this, and, for example, the selection circuit 131 may switch the signal lines 124 for supplying the image signals out of the plurality of signal lines 124 so that image signals are written in a different order for one or more rows of the plurality of pixels 110 that are arranged in a matrix pattern. In other words, the selection circuit 131 may change the order for selecting the signal lines 124 for supplying image signals out of the plurality of signal lines 124 for each of the plurality of rows. In addition, in the present embodiment, the selection circuit 131 selected the signal lines 124 for supplying image signals so that an order for selecting signal lines 124 for supplying image signals out of the plurality of signal lines 124 became a reverse order in accordance with a respective horizontal scan period, but there is no limitation to this. Any combination of orders is sufficient if it is possible to make the amount of time in which an image signal is held in a signal line 124 more equal when averaged by a plurality of horizontal scan periods in the entirety of the display region 101. For example, in the present embodiment, description is given for an example of supplying image signals to the signal lines 124 by two types of orders, but there may be three or more types of orders for supplying image signals to the signal lines 124.

Figure 7:
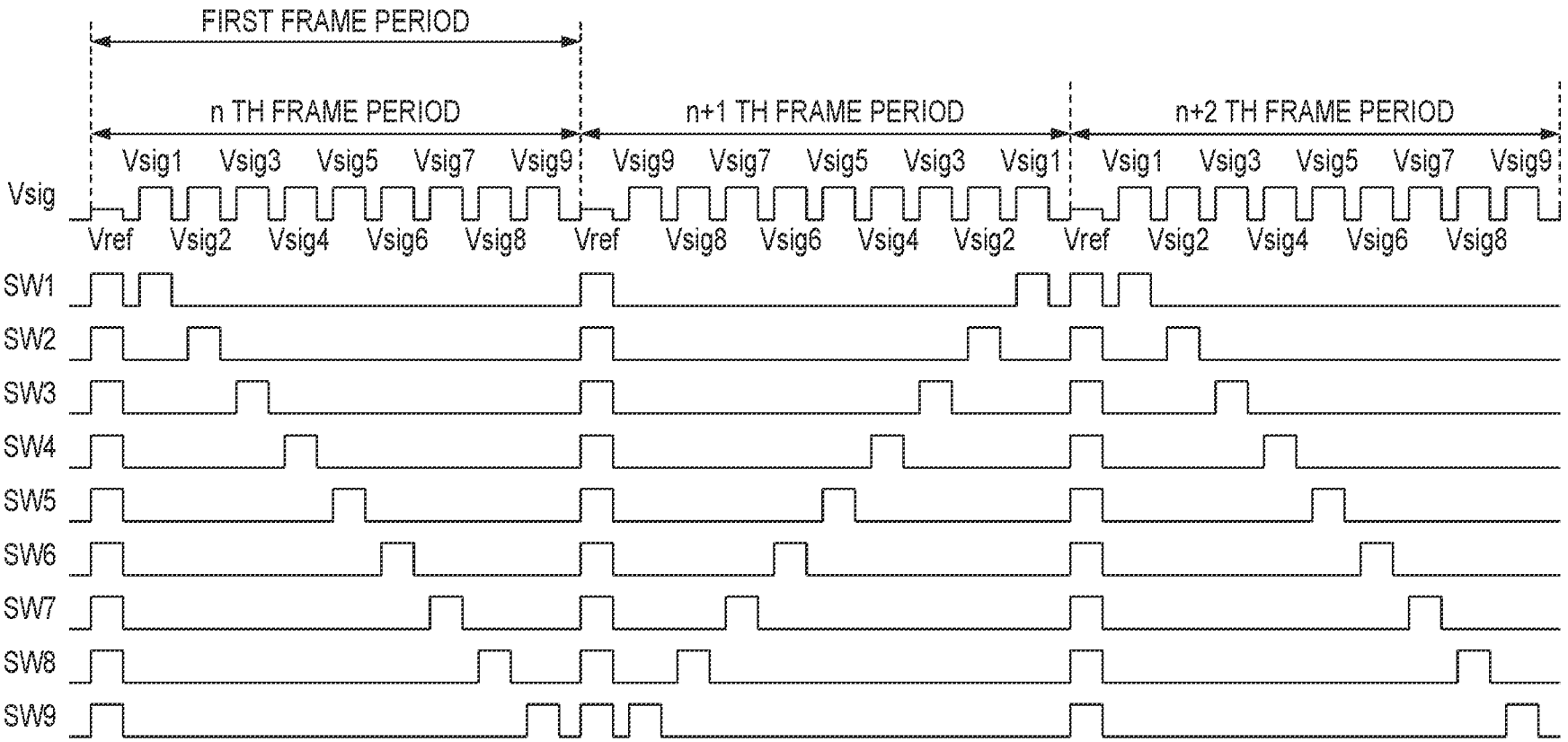
FIG. 7 is a diagram that illustrates an example of a driving method of a selection circuit of the display device of FIG. 1.

With reference to FIG. 7, description is given regarding a configuration of a display device according to embodiments of the present invention, and a method of driving the same. FIG. 7 is a timing chart for describing a method of driving the selection circuit 131 of the display device 100 in a second embodiment of the present invention. Unlike the first embodiment described above, an order in which the switch circuits SW are made to enter the on state and the image signal is supplied to the signal line 124 differs in accordance with the frame period. Here, one frame period refers to a period from a timing for writing an initialization voltage Vref to the signal line 124 for a row until when the initialization voltage Vref is written to the next row. For the selection circuit 131, at each pixel arranged in the first row out of the pixels 110 aligned in the row direction, an order for selecting the signal lines 124 to supply with an image signal out of the plurality of signal lines 124 differs between a first frame period and a second frame period different from the first frame period. In other words, at each pixel aligned in the row direction out of the plurality of pixels 110, when a horizontal scan period of a frame period is extracted, there is a horizontal scan period in which an order for writing the image signal is different.

At each pixel aligned in the row direction out of the plurality of pixels 110, in the n-th frame period, with respect to the nine signal lines 124, the selection circuit 131 has the switch circuits SW1, SW2, SW3, . . . , SW9 enter the on state in this order. In response to this, image signals are supplied to the corresponding signal lines 124 in an order of the image signals Vsig1, Vsig2, Vsig3, . . . Vsig9. Subsequently, a signal is applied to the scanning line 121 of the corresponding row, the selection transistors 113 connected to the scanning line 121 enter the on state all at once, and the image signals are written to the capacitive elements 116 of the pixels 110. In this row, in the (n+1)-th frame period, the selection circuit 131 makes the switch circuits SW9, SW8, SW7, . . . , SW1 enter the on state in this order, with respect to the nine signal lines 124. In response to this, signal voltages are supplied to the corresponding signal lines 124 in an order of the image signals Vsig9, Vsig8, Vsig7, . . . , Vsig1. Subsequently, a signal is applied to the scanning line 121 of the corresponding row, the selection transistors 113 connected to the scanning line 121 enter the on state all at once, and the image signals are written to the capacitive elements 116 of the pixels 110.

Furthermore, in the (n+2)-th frame period, the selection circuit 131 makes the switch circuits SW enter the on state in the same order as in the n-th frame period, and thereby the image signal is supplied to the corresponding signal lines 124. In the (n+3)-th frame period and thereafter, image signals are respectively supplied to the signal lines 124 in similar orders for (n+1)-th horizontal scan period and the (n+2)-th horizontal scan period.

In this way, by having the order for supplying image signals to the signal lines 124 be an order that differs in accordance with the frame period, it is possible to make the amount of time that the image signals are held by the signal lines 124 be more equal when averaged over a plurality of frame periods. Accordingly, the luminance difference of the organic light emitting element 111 that occurs for each column is averaged for each of a plurality of frames, and thus the luminance difference of the organic light emitting element 111 in the time axis is averaged, and it is possible to suppress display unevenness for the display region 101 as a whole.

With the configuration illustrated in FIG. 7, illustration was given for an example where, in one row of pixels that are aligned in the row direction out of the plurality of pixels 110, the selection circuit 131 changed the order for selecting the signal lines 124 for supplying the image signal out of the plurality of signal lines 124, for each mutually adjacent frame period. However, there is no limitation to this, and for example, configuration may be taken such that, in one row, the selection circuit 131 switches the signal lines 124 to supply with image signals out of the plurality of signal lines 124 so that the image signal is supplied at different orders for each one or more frame periods. In other words, the selection circuit 131 may change the order for selecting the signal lines 124 for supplying image signals out of the plurality of signal lines 124 for each of the plurality of frames. It is sufficient if the amount of time that an image signal is held in each signal line 124 can be made to be more equal when averaged across a plurality of frame periods.

Figure 8:
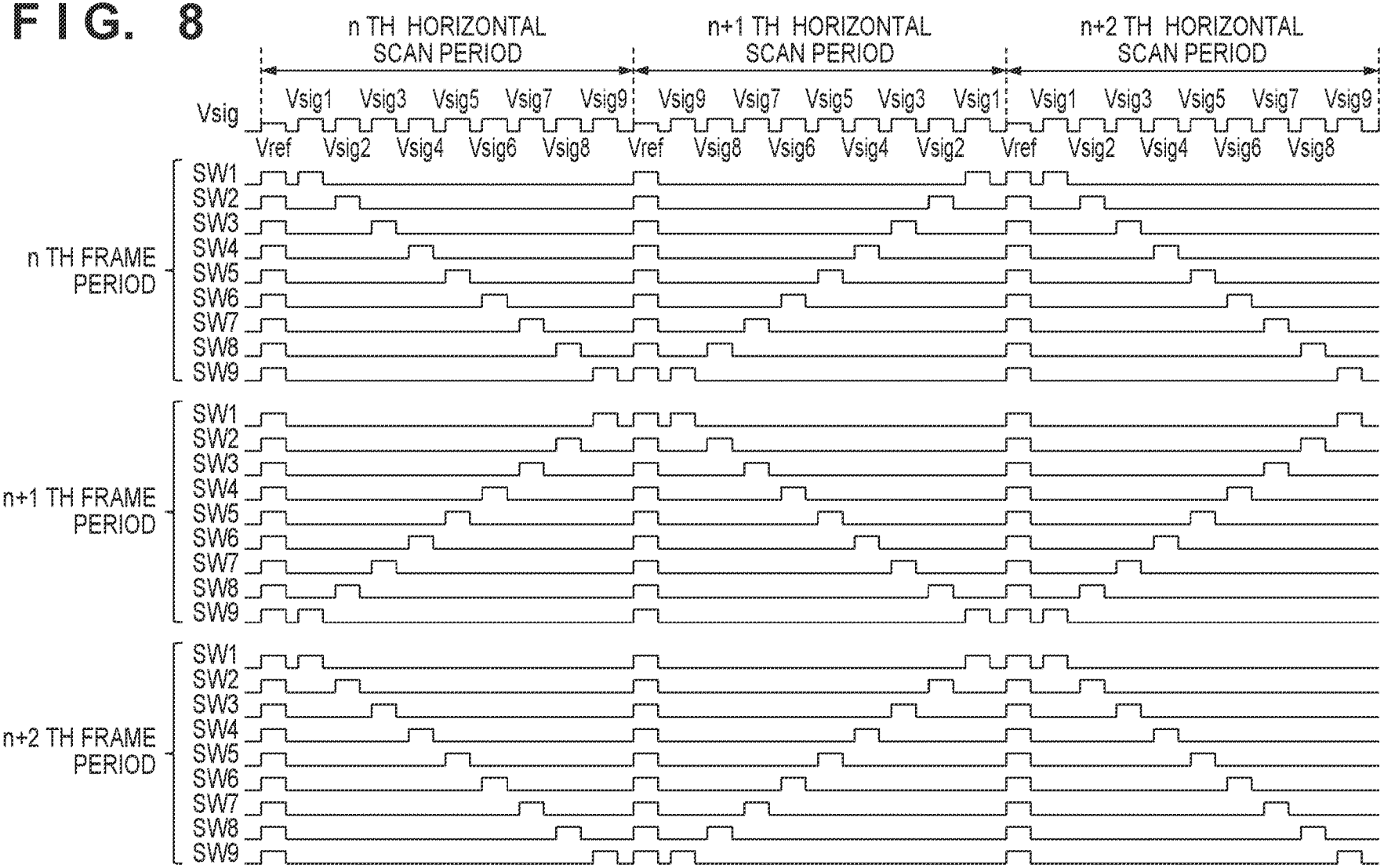
FIG. 8 is a diagram that illustrates an example of a driving method of a selection circuit of the display device of FIG. 1.
Figure 9:
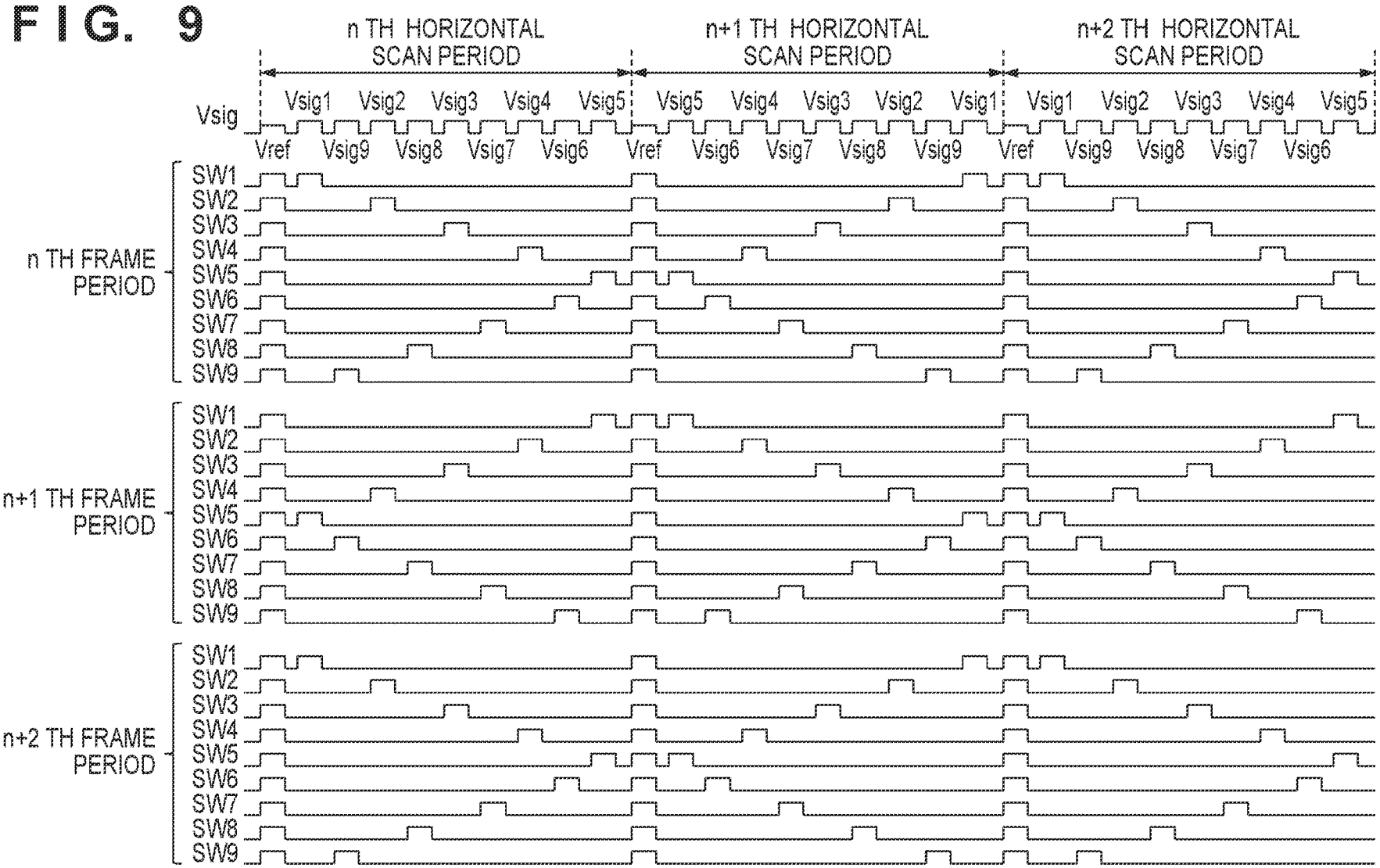
FIG. 9 is a diagram that illustrates an example of a driving method of a selection circuit of the display device of FIG. 1.

With reference to FIGS. 8 and 9, description is given regarding a configuration of a display device according to embodiments of the present invention, and a method of driving the same. FIG. 8 is a timing chart for describing a method of driving the selection circuit 131 of the display device 100 in a third embodiment of the present invention.

In the first embodiment and in the second embodiment described above, configuration is taken to have the amount of time that an image signal is held by each signal line 124 be more equal by changing the order for supplying an image signal to a signal line 124 in accordance with one of the horizontal scan period or frame period. In contrast, in the present embodiment, as illustrated in FIG. 8, the selection circuit 131 switches the signal line 124 to supply with a signal out of the plurality of signal lines 124 so that the image signal is supplied to the signal lines 124 in an order different for both of the horizontal scan period and the frame period. In FIG. 8, in the n-th frame period, the selection circuit 131 selects the signal lines 124 for supplying image signals so that the image signals are supplied at different orders for each mutually adjacent row out of the plurality of pixels 110 arranged in the matrix pattern, in other words for each horizontal scan period. Next, in the (n+1)-th frame period, the selection circuit 131 selects the signal lines 124 for supplying image signals so that the image signals are supplied at a different order from that in the n-th frame period for each row aligned in the row direction in the plurality of pixels 110. In this way, by driving the selection circuit 131 so as to have the order for supplying the image signals to the signal lines 124 be an order that is different in accordance with the horizontal scan period and the frame period, it is possible to have the amount of time in which an image signal is held by a signal line 124 be more equal. As a result, the luminance difference for each column is reduced in the display device 100, and display unevenness for the display region 101 overall is suppressed.

In addition, in the configurations illustrated in FIGS. 6 through 8, the selection circuit 131 selects the signal lines 124 for supplying the image signals in an order from one end out of the plurality of signal lines 124 aligned in the row direction (the end on the side of the switch circuit SW1) to the other end (the end on the side of the switch circuit SW9), in a horizontal scan period (or a frame period). Next, in a horizontal scan period (or frame period) different to this horizontal scan period (or frame period), the selection circuit 131 selects the signal lines 124 for supplying the image signals in an order from the other end out of the plurality of signal lines 124 aligned in the row direction (the end on the side of the switch circuit SW9) to the one end (the end on the side of the switch circuit SW1). However, the order in which the selection circuit 131 selects the signal lines 124 for supplying image signals out of the plurality of signal lines 124 is not limited to this. As illustrated in FIG. 9, the selection circuit 131 selects the signal line 124 for supplying the image signals in an order from a signal line 124 arranged outward from among the plurality of signal lines 124, and then a signal line 124 arranged inside, in a horizontal scan period (or frame period). Next, in a horizontal scan period (or frame period) different from this horizontal scan period (or frame period), the selection circuit 131 may select the signal lines 124 for supplying the image signals in an order from a signal line arranged inward out of the plurality of signal lines 124 to a signal line 124 arranged outward.

For example, as illustrated in FIG. 9, in a horizontal scan period (or frame period), firstly the selection circuit 131 selects the signal line 124 connected to the switch circuit SW1 (or the switch circuit SW9) which is outermost out of the plurality of signal lines 124, and supplies an image signal. Next, the selection circuit 131 selects the signal line 124 connected to the switch circuit SW9 (or the switch circuit SW1) which is the other outward side, and supplies an image signal. Next, the selection circuit 131 selects the signal line 124 connected to the switch circuit SW2 (or the switch circuit SW8) which is outward out of the signal lines 124 that have not yet been selected, and supplies an image signal. By successively repeating this, finally the selection circuit 131 selects the signal line 124 connected to the switch circuit SW5 which is the innermost out of the plurality of signal lines 124, and supplies an image signal. In addition, in a horizontal scan period (or frame period) different from the horizontal scan period (or frame period) described above, firstly the signal line 124 connected to the switch circuit SW5 which is the innermost out of the plurality of signal lines 124 is selected, and supplied with an image signal. Next, the selection circuit 131 selects the signal line 124 connected to the switch circuit SW6 (or the switch circuit SW4) which is inward out of the signal lines 124 that have not yet been selected, and supplies an image signal. Next, the selection circuit 131 selects the signal line 124 connected to the switch circuit SW4 (or the switch circuit SW6) which is inward out of the signal lines 124 that have not yet been selected, and supplies an image signal. By successively repeating this, finally the selection circuit 131 selects the signal line 124 connected to the switch circuit SW1 (the switch circuit SW9) which is the outermost out of the plurality of signal lines 124, and supplies an image signal.

Similarly to the comparative example illustrated in FIG. 5, the selection circuit 131 selects the signal lines 124 for supplying an image signal so that the signal line 124 to which an image signal is first written in one horizontal scan period is not adjacent to the signal line 124 to which an image signal is written to last. As a result, the luminance difference arising between signal lines 124 of the display block 126 that are mutually adjacent is reduced, and it is possible to alleviate display unevenness that has a vertical stripe shape. In addition, by making the order for writing the image signal to the signal lines 124 be an order that differs in accordance with the horizontal scan period and the frame period, it is possible to make the amount of time that an image signal is held by a signal line 124 be more equal. As a result, the luminance difference for each column is reduced in the display device 100, and it is possible to suppress display unevenness for the display region 101 overall.

Three embodiments according to the present invention are described above, but it goes without saying that the present invention is not limited to these embodiments, and the embodiments described above can be changed or combined as appropriate in a scope that does not deviate from the spirit of the present invention.

The display device 100 as above can be embedded in various electronic devices. A camera, a computer, a mobile terminal, an in-vehicle display device, or the like can be given, for example as such an electronic device. The electronic device can include the display device 100 and a control unit for controlling driving of the display device 100, for example.

Figure 10:
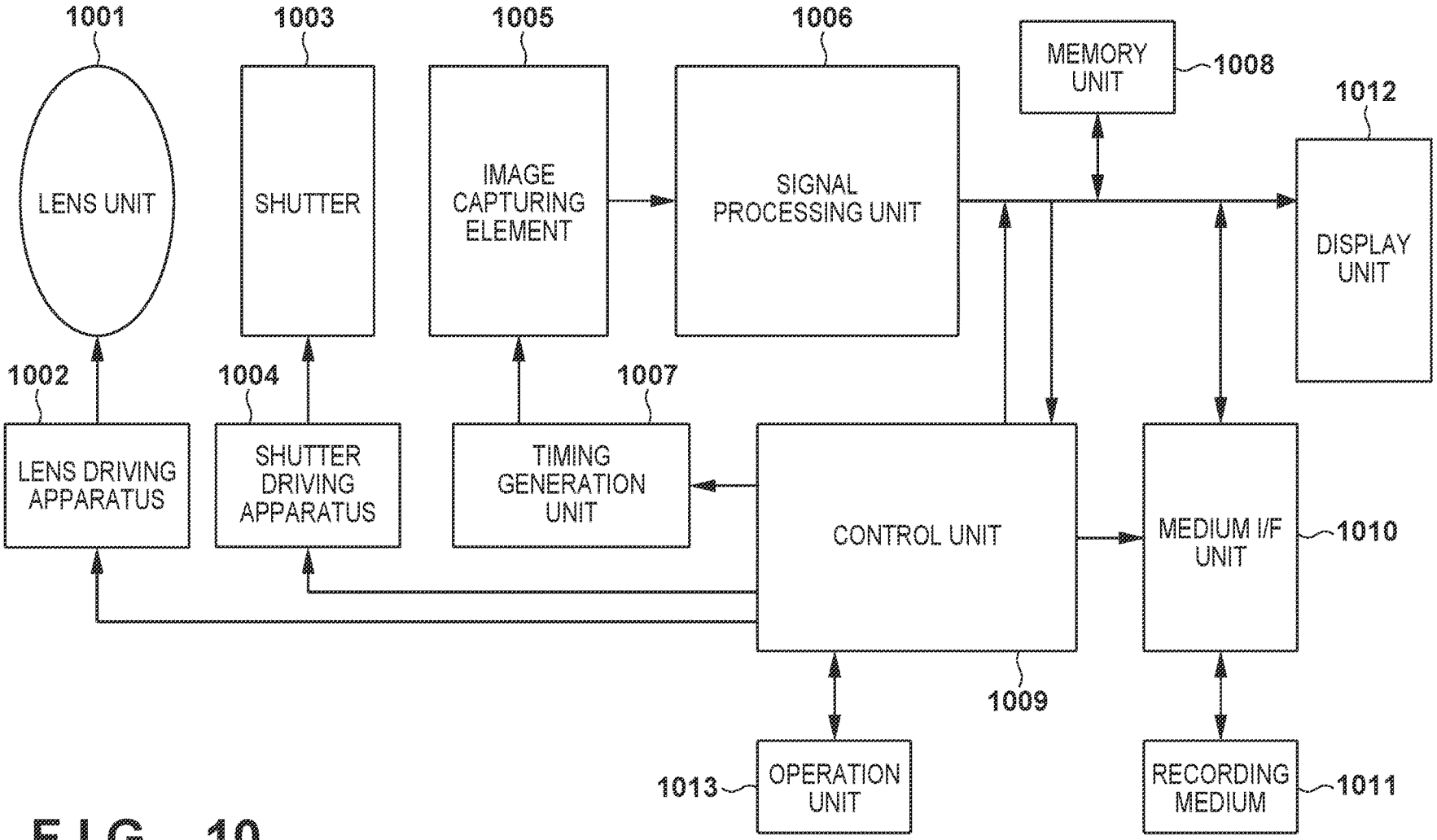
FIG. 10 is a block diagram that illustrates a configuration example of a camera in which the display device in FIG. 1 is used.

Using FIG. 10, description is given here regarding an embodiment that applies the display device 100 described above to a display unit of a digital camera. A lens unit 1001 is an image capturing optical system for causing an optical image of a subject to be formed on an image capturing element 1005, and includes a focus lens, a zoom lens, an aperture, or the like. Driving of an aperture diameter, a magnification lens position, a focus lens position or the like in the lens unit 1001 is controlled by a control unit 1009 through a lens driving apparatus 1002.

A mechanical shutter 1003 is arranged between the lens unit 1001 and the image capturing element 1005, and driving thereof is controlled by the control unit 1009 through a shutter driving apparatus 1004. The image capturing element 1005 converts the optical image formed by the lens unit 1001 into an image signal in accordance with a plurality of pixels. A signal processing unit 1006 performs an A/D conversion, demosaicing processing, white balance control processing, encoding processing, or the like on an image signal outputted from the image capturing element 1005.

A timing generation unit 1007 outputs various timing signals to the image capturing element 1005 and the signal processing unit 1006. The control unit 1009, for example, has memories (ROM, RAM) and a microprocessor (CPU), and controls each unit by loading a program stored in the ROM into the RAM, and having the CPU execute the program to thereby realize various functions of a digital camera. Functions realized by the control unit 1009 include auto focus detection (AF) and auto exposure control (AE).

A memory unit 1008 is where the control unit 1009 or the signal processing unit 1006 temporarily store image data, and is used as a work region. A medium I/F unit 1010 is an interface for reading or writing to or from a recording medium 1011 which is a detachable memory card, for example. A display unit 1012 displays a captured image or various information of the digital camera. The display device 100 described above can be applied to the display unit 1012. The display device 100 mounted to the digital camera as the display unit 1012 is driven by the control unit 1009 and displays an image or various pieces of information. An operation unit 1013 is a user interface for a user to perform settings or instructions with respect to the digital camera, such as a power supply switch, a release button, or a menu button.

Next, description is given regarding operation of the digital camera at a time of capturing. When a power supply is turned on, a capture standby state is entered. The control unit 1009 starts moving image capturing processing and display processing for causing the display unit 1012 (the display device 100) to operate as an electronic view finder. When an image capturing preparation instruction (a half press of the release button of the operation unit 1013, for example) is inputted in the capture standby state, the control unit 1009 starts focus detection processing.

The control unit 1009 then obtains a movement amount and a movement direction of the focus lens of the lens unit 1001 from an obtained defocus amount and direction, drives the focus lens via the lens driving apparatus 1002, and adjusts the focal point of the image capturing optical system. Configuration may be taken such that, after the driving, focus detection based on a contrast evaluation value is further performed, and the focus lens position is finely adjusted as necessary.

Subsequently, when an image capturing start instruction (a full press of the release button for example) is inputted, the control unit 1009 executes an operation for capturing an image to be recorded, obtained image data is processed by the signal processing unit 1006 and stored in the memory unit 1008. The control unit 1009 records image data stored in the memory unit 1008 to the recording medium 1011 via a medium control I/F unit 1010. In addition, at this point the control unit 1009 may drive the display unit 1012 (the display device 100) so as to display the captured image. In addition, the control unit 1009 may output the image data from an external I/F unit (not shown) to an external apparatus such as a computer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-103791, filed May 25, 2017 which is hereby incorporated by reference wherein in its entirety.

What is claimed is:

1. A display device comprising a plurality of selection circuits and a plurality of display blocks which are arranged such that one selection circuit corresponds to one display block, wherein each of the plurality of display blocks comprises a plurality of signal lines extending in a column direction, and a plurality of pixels each connected to a corresponding one of the plurality of signal lines and arranged in a matrix pattern in the column direction and a row direction that intersects the column direction, wherein the plurality of pixels each comprise a light emitting element, wherein each of the plurality of selection circuits selects a signal line to which an image signal is supplied, among the plurality of signal lines, such that the image signal is written to a corresponding one of pixels aligned in the row direction among the plurality of pixels, wherein each of the plurality of selection circuits selects a signal line from the plurality of signal lines in an order from one end side to another end side aligned in the row direction in a frame period such that each of image signals is supplied to a corresponding one of pixels aligned in a first row among the plurality of pixels, and wherein each of the plurality of selection circuits selects a signal line from the plurality of signal lines in an order from the another end side to the one end side aligned in the row direction in the frame period such that each of image signals is supplied to a corresponding one of pixels aligned in a second row that is different from the first row among the plurality of pixels.

2. The display device according to claim 1, wherein in one frame period, an order in which each of the plurality of selection circuits selects a signal line to which an image signal is supplied from the plurality of signal lines differs for each pair of mutually adjacent rows of the plurality of pixels arranged in the matrix pattern.

3. The display device according to claim 1, wherein each of the plurality of selection circuits selects, in a first frame period, the signal line from the plurality of signal lines in the order from the one end side to the another end side aligned in the row direction such that each of image signals is supplied to the corresponding one of pixels aligned in the first row, and wherein each of the plurality of selection circuits selects, in a second frame period different from the first frame period, a signal line from the plurality of signal lines in an order from the another end side to the one end side aligned in the row direction such that each of image signals is supplied to a corresponding one of pixels aligned in the first row.

4. The display device according to claim 3, wherein in the first row, an order in which the plurality of selection circuits selects a signal line to which an image signal is supplied among the plurality of signal lines differs for each pair of mutually adjacent frame periods.

5. The display device according to claim 1, wherein a number of signal lines comprised in the plurality of signal lines are the same in each display block of the plurality of display blocks.

6. An electronic device comprising a display device comprising a plurality of selection circuits and a plurality of display blocks are arranged such that one selection circuit corresponds to one display block, wherein each of the plurality of display blocks comprises a plurality of signal lines extending in a column direction, and a plurality of pixels each connected to a corresponding one of the plurality of signal lines and arranged in a matrix pattern in the column direction and a row direction that intersects the column direction, wherein the plurality of pixels each comprise a light emitting element, wherein each of the plurality of selection circuits selects a signal line to which an image signal is supplied among the plurality of signal lines, such that the image signal is written to a corresponding one of pixels aligned in the row direction among the plurality of pixels, wherein each of the plurality of selection circuits selects a signal line from the plurality of signal lines in an order from one end side to another end side aligned in the row direction in a frame period such that each of image signals is supplied to a corresponding one of pixels aligned in a first row among the plurality of pixels, and wherein each of the plurality of selection circuits selects a signal line from the plurality of signal lines in an order from the another end side to the one end side aligned in the row direction in the frame period such that each of image signals is supplied to a corresponding one of pixels aligned in a second row that is different from the first row among the plurality of pixels.

* * * * *